US005681172A

United States Patent [19]

Moldenhauer

[11] Patent Number: 5,681,172

[45] Date of Patent: Oct. 28, 1997

[54] MULTI-POLE ELECTRICAL CONNECTOR WITH GROUND CONTINUITY

[75] Inventor: David William Moldenhauer, Goldsboro, N.C.

[73] Assignee: Cooper Industries, Inc., Houston, Tex.

[21] Appl. No.: 551,330

[22] Filed: Nov. 1, 1995

[51] Int. Cl.[6] ..... H01R 13/648

[52] U.S. Cl. ..... 439/95; 439/98

[58] Field of Search ..... 439/95–99, 610

[56] References Cited

U.S. PATENT DOCUMENTS

| | | | |
|---|---|---|---|
| 3,015,794 | 1/1962 | Kishbaugh | 439/95 |
| 3,643,208 | 2/1972 | Massa, Jr. | 439/610 |
| 3,990,765 | 11/1976 | Hill | 439/610 |
| 5,102,344 | 4/1992 | Tadokoro et al. | 439/98 |
| 5,478,254 | 12/1995 | Holt | 439/610 |
| 5,490,789 | 2/1996 | Simons | 439/101 |

*Primary Examiner*—Gary F. Paumen

*Attorney, Agent, or Firm*—Burns, Doane, Swecker & Mathis, L.L.P.

[57] ABSTRACT

An electrical connector includes a grounded cable joined to a coupler, with an electrically insulative casing molded around adjoining ends of the cable and coupler. The coupler is adapted to be electrically connected to an electric receptacle and includes an insulative insert containing rear electrical contacts connected to respective signal lines of the cable. The rear contacts are electrically connected to front contacts which are to receive the male contacts of the receptacle. An electrically conductive ferrule is mounted on the insert and extends rearwardly therefrom to a connection point with a ground wire of the cable. A cylindrical front portion of the ferrule extends across a gap between the casing and a threaded nut which is freely rotatably mounted on the insert, to provide ESD (electro-static filed) shielding for the cable. The nut, formed of an electrically conductive material, contacts the ferrule and maintains ground continuity between the ground wire and the receptacle.

16 Claims, 2 Drawing Sheets

FIG. 1
(PRIOR ART)
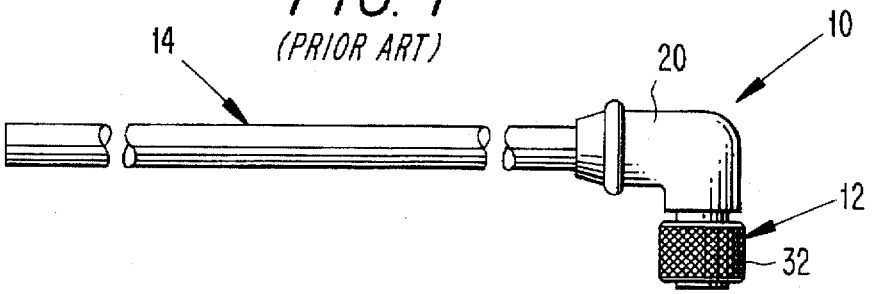
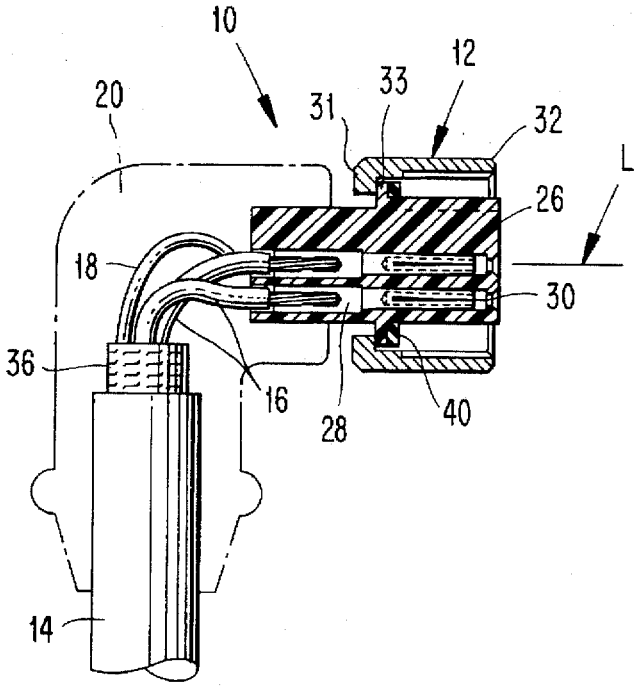
FIG. 2
(PRIOR ART)
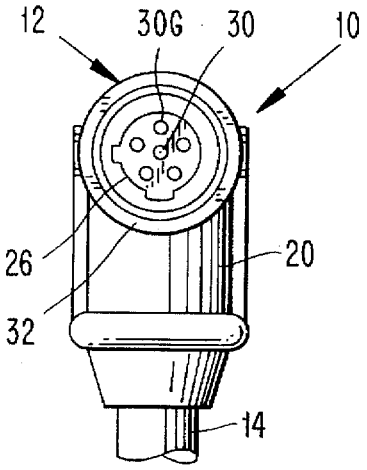
FIG. 3
(PRIOR ART)
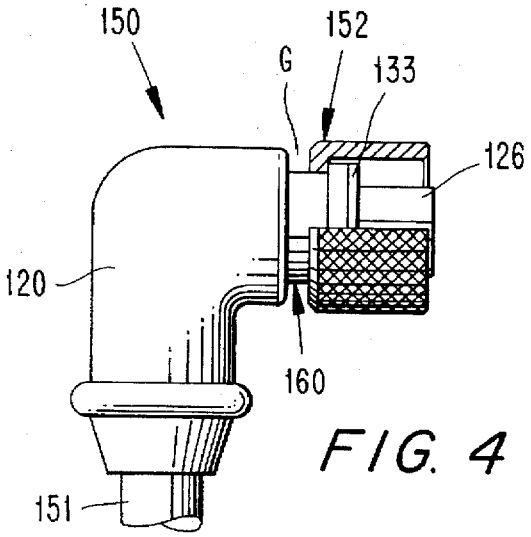
FIG. 4

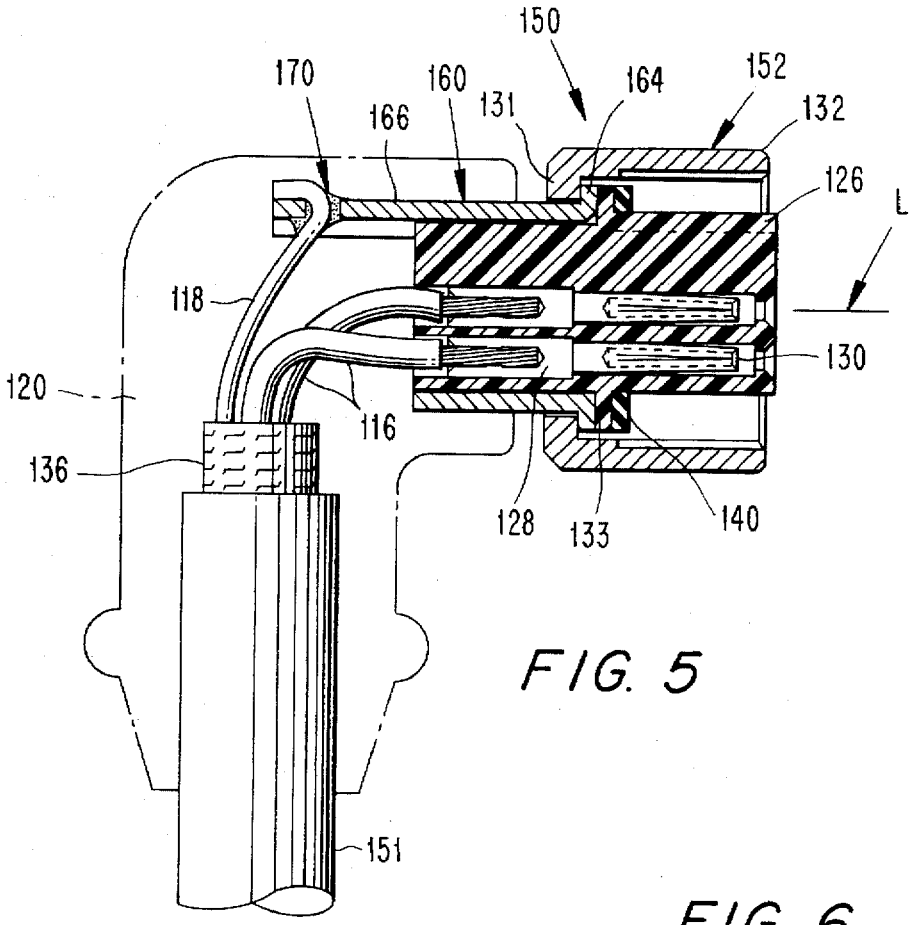
FIG. 5
FIG. 6
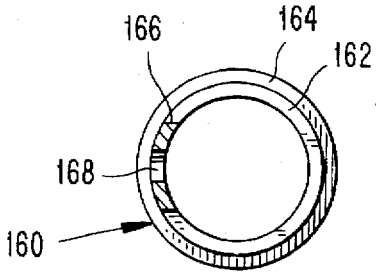
FIG. 7
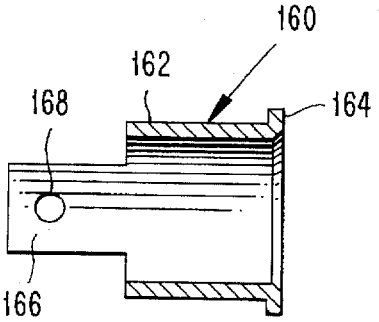
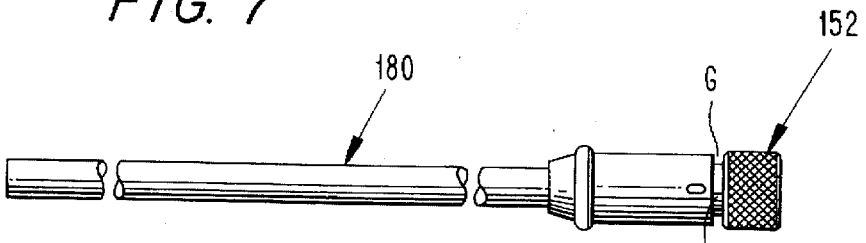
FIG. 8

MULTI-POLE ELECTRICAL CONNECTOR WITH GROUND CONTINUITY

BACKGROUND OF THE INVENTION

The invention relates to an electrical connector, and in particular to the provision of ground continuity in a multi-pole coupler of such a connector.

One type of electrical connector 10 currently in use is depicted in FIGS. 1–3. That connector 10, sometimes called a micro-mini connector, comprises a female coupler 12 attached to a conventional multi-conductor, shielded cable 14 including a shield 36. The cable typically comprises a plurality of signal lines 16 plus a ground or drain wire 18. In the disclosed embodiment, there are five signal lines 16. The five signal lines and ground wire are electrically connected to the coupler 12, and a casing 20 is injection molded around the adjoining ends of the cable and coupler. The casing comprises an electrically insulative material such as PVC.

The female coupler 12 includes a generally cylindrical insert or body 26 formed of an electrically insulative material such as PVC. Contained in the insert are six electrical contacts 28 which receive the signal lines 16 and the ground wire 18. The contacts 28 are in electrical connection with respective female contacts 30 adapted to receive male contacts provided in a conventional receptacle (not shown) to which the coupler 12 is to be joined.

Surrounding the insert 26 is an internally screw-threaded nut 32 freely rotatable about a center axis L. A rear end of the nut includes a radially inwardly projecting flange 31 that is engageable with a rear face of a radially outwardly projecting flange 33 of the insert 26. The nut is to be threadedly connected to an external screw thread formed on the receptacle, in order to draw the coupler 12 toward the receptacle to join the female contacts 30 of the coupler with the male contacts of the receptacle.

Once that has been accomplished, the signal lines 16 will be in electrical communication with respective signal lines in the receptacle, and the ground wire will be in electrical communication with a ground contact of the receptacle. That ground contact is connected by a pig-tail lead wire to the panel or enclosure in which the receptacle is mounted, thus transmitting ground continuity from the cable 14 to the enclosure. A waterproof seal is provided by an elastomeric gasket 40 which becomes compressed between the flange 33 and the receptacle.

The coupler depicted in FIGS. 1–3 is a six pole coupler, with five of the poles dedicated to signal lines, and one of the poles (e.g., contact 30G in FIG. 3) dedicated to ground continuity.

It would be desirable in certain applications to be able to increase the number of signal lines without changing the size of the coupler (i.e., so that the coupler can still be attached to the standard receptacle), and while maintaining ground continuity.

SUMMARY OF THE INVENTION

The present invention relates to an electrical connector comprising a cable which contains a plurality of signal lines and a ground wire, and a coupler joined to the cable for electrically connecting the signal lines and ground wire to a receptacle. The coupler comprises an insert possessing a plurality of rear electrical contacts disposed at a rear portion of the insert. A plurality of front contacts is disposed at a front portion of the insert. The rear contacts are electrically connected to respective ones of the signal lines, and the front contacts are electrically connected to respective ones of the rear contacts and are electrically connectable with respective contacts of a receptacle. A screw-threaded nut is freely rotatably mounted on an outer periphery of the front portion of the insert and is arranged to apply a forwardly directed force to the insert when the nut is secured to a screw thread of the receptacle. The nut is formed of an electrically conductive material. A ferrule, formed of an electrically conductive material, is mounted on an outer periphery of the rear portion of the insert. A front end of the ferrule is electrically connected to a rear end of the nut. A rear end of the ferrule is connected to the ground wire. An electrically insulative casing is formed around portions of the cable and insert and encases the sections of the signal lines and ground wire extending to the coupler.

Preferably, a rear portion of the ferrule is electrically connected to the ground wire at a location spaced rearwardly from the insert.

The ferrule preferably includes a cylindrical front section surrounding the rear portion of the insert, and a connector portion extending rearwardly of the insert and electrically connected to the ground wire. The cylindrical portion of the ferrule surrounds the insert in a gap disposed between the nut and casing.

The cylindrical front section of the ferrule preferably terminates forwardly in the shape of a radially outward flange which is compressed axially between a radial outward flange of the insert and a radial inward flange of the nut.

BRIEF DESCRIPTION OF THE DRAWING

The objects and advantages of the invention will become apparent from the following detailed description of a preferred embodiment thereof in connection with the accompanying drawing, in which like numerals designate like elements and in which:

FIG. 1 is a side elevational view of a prior art electrical connector;

FIG. 2 is a longitudinal sectional view taken through a coupler component of the connector depicted in FIG. 1, with an insulative casing of the electrical connector shown in phantom;

FIG. 3 is a front elevational view of the connector depicted in FIG. 2;

FIG. 4 is a side elevational view, partly broken away, of an electrical connector according to the present invention;

FIG. 5 is a view similar to FIG. 2 of the connector depicted in FIG. 4;

FIG. 6 is a longitudinal sectional view taken through a ferrule component of the coupler;

FIG. 7 is a rear end view of the ferrule component depicted in FIG. 6; and FIG. 8 is a side elevational view of another type of electrical connector to which the present invention is applicable.

DETAILED DESCRIPTION OF A PREFERRED EMBODIMENT OF THE INVENTION

One preferred embodiment of an electrical connector 150 according to the present invention is depicted in FIGS. 4–7. Components of that connector 150 that are the same as those of the earlier described prior art connector 10 described in connection with FIGS. 1–3 are provided with the same reference numerals increased by a value of one hundred. The connector 150 comprises a female coupler 152 attached to a conventional multi-conductor, shielded cable 151 having a shield 136. The cable comprises a plurality of signal lines 116, plus a ground or drain wire 118. A casing 120 is injection molded around the adjoining ends of the cable and coupler. The casing comprises an electrically insulative material such as PVC.

The female coupler 152 includes a generally cylindrical insert or body 126 formed of an electrically insulative material such as PVC. Contained in the insert are six electrical contacts 128 which receive respective signal lines 116. In the disclosed embodiment, there are six signal lines 116, in contrast to the five signal lines of the connector of FIGS. 1–3. Thus, in contrast to that prior art coupler, each of the contacts 128 receives a signal line 116. The cable 151 is different from the earlier mentioned cable 14 only in that it includes six signal lines 116 and one ground wire 118 (as opposed to five signal lines and one ground wire in the earlier described cable). The contacts 128 are in electrical connection with female electrical contacts 130 that are adapted to receive male contacts provided in a receptacle (not shown) to which the coupler 152 is to be joined.

Surrounding the insert 126 is an internally screw-threaded nut 132 which is freely rotatable about a center axis L. A rear end of the nut includes a radially inwardly projecting flange 131. The nut 132 is to be threadedly connected to an external screw thread formed on the receptacle, in order to draw the coupler 152 toward the receptacle and thereby join the female contacts 130 of the coupler with the male contacts of the receptacle.

Mounted on the outer periphery of the rear position of the insert 126 is a ferrule 160 shown in FIGS. 5–7. The ferrule, formed of an electrically conductive material, such as nickel-plated brass for example, includes a cylindrical front portion 162 whose forward end forms a radially outwardly projecting flange 164 situated between the flanges 133 and 131 of the insert 126 and nut 132, respectively. Projecting rearwardly from the cylindrical portion 162 of the ferrule is a tab 166 having a hole 168 formed therein.

Prior to the formation of the casing 120 around the cable and coupler, the ferrule 160 is fixedly attached to the insert 126, e.g., by an adhesive disposed along the interface between the ferrule 160 and the insert 126, with the front flange 164 of the ferrule abutting the rear face of the flange 133 of the insert.

The ground wire 118 is electrically connected to the hole 168 of the ferrule by solder 170, or by any other suitable expedient, such as welding, crimping, mechanical fasteners, etc.

It will be appreciated that when the nut 132 is screwed onto a receptacle to connect the coupler 152 to the receptacle, the flange 131 of the nut 132 will firmly contact the rear face of the flange 164 of the ferrule 160 to make electrical contact therewith. Accordingly, ground continuity will be established from the ground wire 118 to the ferrule 160, then from the ferrule flange 164 to the nut 132, then from the nut to the external threads of the receptacle housing or shell (not shown), and then from the receptacle shell to the panel or enclosure (not shown) in which the receptacle is mounted.

Since the nut 132 acts as an electrical conductor, it is preferable to form the nut of an electrically low-resistance material, such as stainless steel, for example.

It will be appreciated that since the ground wire 118 is connected at a location spaced rearwardly from the insert 126, there is no need for any of the contacts 128 to be dedicated to ground continuity. Rather, all of the contacts 128 can be connected to signal lines, thereby increasing the pole capacity of the connector.

Since the cylindrical portion 162 of the ferrule extends across the gap G, disposed between the nut 132 and the casing 120, in surrounding relationship to the insert, the ferrule performs an ESD (electro-static field) shielding function in that gap, thereby improving the shield characteristics of the connector. In contrast, such shielding is not present in the corresponding gap of the prior art connector of FIGS. 1–3.

An elastomeric gasket 140 becomes compressed between the flange 133 and the receptacle to provide a waterproof seal therebetween. In addition, the compressed gasket imparts a continuous rearward bias to the flange 133, tending to keep the flange 164 in electrical contact with the flange 162, even if there occurs a slight loosening of the nut 132.

In operation, the connector makes connection with a receptacle (not shown) by aligning male contacts of the receptacle with the female contacts 130 of the coupler 152, and then screwing the nut 132 onto the receptacle to draw those contacts together. At the same time, the flange 131 of the nut makes tight engagement with the flange 164 of the ferrule to act as a ground conductor between the ferrule 160 and the receptacle shell.

All of the contacts 128 are connected to respective signal lines 116. No contact 128 is dedicated to ground continuity, since the ground wire 118 is connected to the ferrule, so the pole capacity is increased without changing the size of the coupler. Hence, the coupler can still be attached to standard receptacles.

The cylindrical portion 162 of the ferrule provides ESD shielding across the gap G disposed between the nut 132 and the casing 120, thereby enhancing the shielding characteristics of the connector.

The invention can be incorporated in connectors of the type wherein the cable extends perpendicularly to the axis L, as shown in FIGS. 1 and 5, as well as in connectors 180 in which the cable extends colinearly with the axis L as shown in FIG. 8.

Although the present invention has been described in connection with a preferred embodiment thereof, it will be appreciated by those skilled in the art that additions, deletions, modification, and substitutions not specifically described may be made without departing from the spirit and scope of the invention as defined in the appended claims.

What is claimed is:

1. An electrical connector comprising:

a cable containing a shield and a plurality of signal lines and a ground wire, said signal lines and ground wire extending through said shield and projecting beyond an end thereof;

a coupler joined to a front end of said cable for electrically connecting said signal lines and ground wire to a receptacle, said coupler comprising:

an insert formed of an electrically insulative material, the insert containing a plurality of rear electrical contacts disposed in a rear portion of said insert, and a plurality of front electrical contacts disposed at a front portion of said insert, rear ends of said rear contacts disposed within said insert and being electrically connected to respective ones of said signal lines which project into said insert, said rear contacts being electrically connected only to said signal lines; said front contacts being electrically connected to respective ones of said rear contacts and being electrically connectable with respective contacts of a receptacle, a screw-threaded nut freely rotatably mounted on an outer periphery of said front portion of said insert and arranged to apply a forwardly directed force to said insert when said nut is secured to a screw thread of the receptacle, said nut formed of an electrically conductive material;

a ferrule mounted on said rear portion of said insert and formed of an electrically conductive material, said ferrule being in electrical contact with said nut, and a rear portion of said ferrule being electrically connected to said ground wire at a location spaced rearwardly from said insert; and an electrically insulative casing formed around said front end of said cable and said rear portion of said insert for encasing sections of said signal lines and ground wire extending to said coupler, and for encasing said electrical contact between said ground wire and said ferrule.

2. The electrical connector according to claim 1, wherein said ferrule includes a cylindrical portion mounted on an outer periphery of said insert and extending across a gap between said nut and said casing and disposed in surrounding relationship to said insert.

3. The electrical connector according to claim 1, wherein said ferrule includes a cylindrical front section surrounding said rear portion of said insert, and a connector portion extending rearwardly of said insert and electrically connected to said ground wire.

4. The electrical connector according to claim 3, wherein a forward end of said cylindrical front section is formed by a radially outward flange which is compressed between a radial outward flange of said insert and a radial inward flange of said nut when said nut is connected to a receptacle.

5. The electrical connector according to claim 4, further including an elastomeric gasket disposed adjacent a front side of said radial outward flange of said insert, said gasket becoming compressed between said flange of said insert and the receptacle to provide a waterproof seal therebetween and impose a rearward bias tending to urge said flanges of said cylindrical front section and said nut into electrical contact with one another.

6. The electrical connector according to claim 1, wherein said front contacts are female contacts, said screw thread of said nut having an internal screw thread.

7. The electrical connector according to claim 1, wherein said ground wire is soldered to said ferrule.

8. The electrical connector according to claim 1, wherein said nut is formed of an electrically low resistance metal.

9. The electrical connector according to claim 8, wherein said ferrule is formed of nickel plated brass.

10. The electrical connector according to claim 9, wherein said nut is formed of stainless steel.

11. The electrical connector according to claim 1, wherein said cable extends coaxially with a central axis of said nut.

12. The electrical connector according to claim 1, wherein said cable extends perpendicularly to a central axis of said nut.

13. A female electrical connector comprising:

a cable containing a plurality of signal lines and a ground wire;

a coupler joined to said cable for electrically connecting said signal lines and ground wire to a receptacle, said coupler comprising:

an insert containing a plurality of rear electrical contacts disposed at a rear portion of said insert, and a plurality of front electrical contacts disposed at a front portion of said insert, said rear contacts being electrically connected to respective ones of said signal lines, said front contacts comprising female contacts electrically connected to respective ones of said rear contacts, said front contacts being electrically connectable with respective contacts of a receptacle, said insert including a radial outward flange disposed intermediate said front and rear portions;

a screw-threaded nut freely rotatably mounted on an outer periphery of said front portion of said insert, a rear end of said nut including a radially inward flange, a front end of said nut being threadedly connectable to a screw thread of a receptacle for drawing the insert toward the receptacle, said nut formed of an electrically conductive material; and a ferrule formed of an electrically conductive material and including a cylindrical portion mounted on an outer periphery of said rear portion of said insert, said ferrule formed of an electrically conductive material, a front end of said cylindrical portion formed as a radially outwardly extending flange sandwiched between said flanges of said insert and said nut, a rear end of said ferrule being connected to said ground wire at a location spaced rearwardly from said insert, whereby ground continuity is established from said ground wire to said nut through said ferrule, said cylindrical portion extending across a gap between said nut and said casing and disposed in surrounding relationship to said insert to provide electro-static shielding across said gap; and an electrically insulative casing formed around adjacent portions of said cable and said insert for encasing sections of said signal lines and ground wire extending to said coupler.

14. The connector according to claim 13, further including an elastomeric gasket disposed adjacent a front side of said radial outward flange of said insert, said gasket becoming compressed between said flange of said insert and the receptacle to provide a waterproof seal therebetween and impose a rearward bias tending to urge said flanges of said cylindrical front section and said nut into electrical contact with one another.

15. An electrical connector comprising:

a cable containing a plurality of signal lines and a ground wire;

a coupler joined to said cable for electrically connecting said signal lines and ground wire to a receptacle, said coupler comprising:

an insert containing a plurality of rear electrical contacts disposed at a rear portion of said insert, and a plurality of front electrical contacts disposed at a front portion of said insert, said rear contacts being electrically connected to respective ones of said signal lines, said front contacts being electrically connected to respective ones of said rear contacts and being electrically connectable with respective contacts of a receptacle, a screw-threaded nut freely rotatably mounted on an outer periphery of said front portion of said insert and arranged to apply a forwardly directed force to said insert when said nut is secured to a screw thread of the receptacle, said nut formed of an electrically conductive material;

a ferrule mounted on said rear portion of said insert and formed of an electrically conductive material, said ferrule being in electrical contact with said nut, and a rear portion of said ferrule being electrically connected to said ground wire wherein a forward end of said ferrule is formed by a radially outward flange which is compressed between a radial outward flange of said insert and a radial inward flange of said nut when said nut is connected to a receptacle; and an electrically insulative casing formed around adjacent portions of said cable and said insert for encasing sections of said signal lines and ground wire extending to said coupler.

16. The electrical connector according to claim 15, wherein said ferrule includes a cylindrical front section surrounding said rear portion of said insert, and a connector portion extending rearwardly of said insert and electrically connected to said ground wire.

* * * * *